US005908341A

United States Patent [19]

dasa

[11] Patent Number: 5,908,341

[45] Date of Patent: *Jun. 1, 1999

[54] TOY FLYING WING GLIDER

[76] Inventor: Madhava dasa, R.R. 1 Box 450-D, Kula, Hi. 96790

[ * ] Notice: This patent issued on a continued prosecution application filed under 37 CFR 1.53(d), and is subject to the twenty year patent term provisions of 35 U.S.C. 154(a)(2).

[21] Appl. No.: 08/767,424

[22] Filed: Dec. 16, 1996

Related U.S. Application Data

[63] Continuation-in-part of application No. 08/226,092, Feb. 14, 1994, abandoned.

[51] Int. Cl.[6] ..... A63H 27/14; A63H 27/01

[52] U.S. Cl. ..... 446/61; 446/63; 446/68

[58] Field of Search ..... 446/61, 62, 63, 446/64, 65, 66, 67, 68

[56] References Cited

U.S. PATENT DOCUMENTS

| | | | |
|---|---|---|---|
| D. 168,724 | 2/1953 | Anderson | 446/61 X |
| 1,615,947 | 2/1927 | Klapka | 446/34 X |
| 2,236,877 | 4/1941 | Jacobs | 446/63 X |
| 2,870,569 | 1/1959 | Bergstrand | 446/68 |
| 3,246,425 | 4/1966 | Miller | 446/66 X |
| 3,715,833 | 2/1973 | Nickerson et al. | 446/68 |
| 3,768,198 | 10/1973 | Fields | 446/64 |
| 4,195,439 | 4/1980 | Kramer | 446/68 |
| 4,324,064 | 4/1982 | Bettencourt et al. | 446/67 X |
| 4,388,777 | 6/1983 | Hermann et al. | 446/61 |

*Primary Examiner*—Robert A. Hafer
*Assistant Examiner*—Laura Fossum

[57] ABSTRACT

A toy glider having a single wing formed from a flat sheet of polystyrene foam, or other material of similar characteristics, and a specific finger gripped launch handle suitably attached to the forward portion of the wing along the longitudinal center-line thereof. The wing may have creases extending transversely from the vicinity of the forward point of the wing tips to or near the midpoint of the trailing edge thereof, the wing portions rearwardly of the creases being angled upwardly by a shallow angle providing majority span wing twist wash out and simultaneously functioning as adjustable elevons.

14 Claims, 3 Drawing Sheets

TOY FLYING WING GLIDER

This application is a continuation-in-part of 08/226,092, filed Feb. 14, 1994, now abandoned.

The present invention pertains to finger gripped hand-launched toy gliders.

DESCRIPTION OF THE PRIOR ART

Generally toy gliders consist of multiple wings, a massive fuselage, a rearward vertical stabilizer and a weight. Toy gliders disclosed in U.S. Pat. Nos. 4,195,439 and 4,388,777 are comprised of a weighting means and a single wing lacking fuselage and verticle stabilizer. U.S. Pat. No. 4,195,439 lacks any launch handle, while the large decorative weight of U.S. Pat. No. 4,388,777 could serve as its launching means. U.S. Pat. Nos. 2,236,877 and 3,768,198 both disclose a hook or tongue means specifically designed to receive an elastic band.

SUMMARY OF THE INVENTION

The primary object of the present invention is to provide an exciting high performance finger launched toy glider of maximum simplicity. This and other objects of the invention which will become apparent hereinafter are achieved by the provision of a toy glider having a single wing formed from a flat sheet of polystyrene foam, or other material of similar characteristics, and a finger gripped launch handle suitably attached to the forward portion of the wing along the longitudinal center-line thereof. The wing may have creases extending transversely from the vicinity of the forward point of the wing tips to the midpoint of the trailing edge thereof, the wing portions rearwardly of the creases being angled upwardly by a shallow angle providing majority span wing twist washout and subsequently functioning as adjustable elevons.

For a more complete understanding of the invention and the objects and advantages thereof, reference should be had to the accompanying drawings and the following detailed description wherein preferred embodiments of the invention are illustrated and described.

DESCRIPTION OF THE PREFERED EMBODIMENTS

Figure 1:
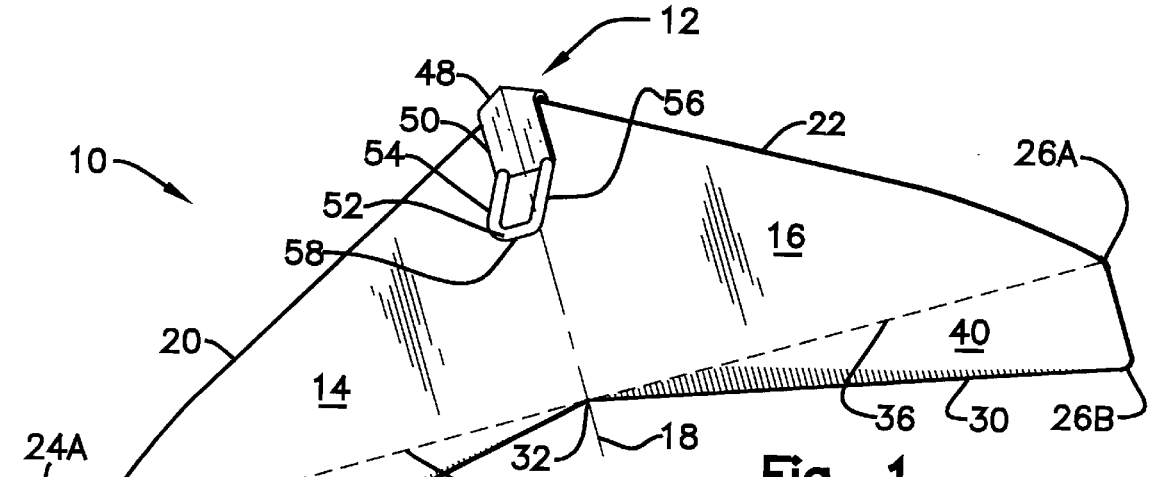
FIG. 1 is a perspective bottom view of a first embodiment of the toy glider of the present invention.

The first embodiment of the toy glider of the present invention, illustrated in FIGS. 1–4, has two parts, a wing 10 and a combined nose weight and launch handle 12. The wing 10 is sweptback and is formed from a flat sheet of polystyrene foam, or other material of similar characteristics, i.e., a semi-rigid, scorable material, and has left and right wing half portions 14, 16 which are generally symetric about the longitudinal centerline 18 of the wing. Each wing half portion 14, 16 has a leading edge 20, 22 extending from the centerline 18 along a straight line or curve, a curve being shown here, to the respective wing end forward points 24A, 26A and a trailing edge 28, 30 extending on a straight or curved line, a straight line being shown here, from the respective wing end rearward points 24B and 26B to a point 32 on the longitudinal centerline. Wing ends in this embodiment are defined as lines 24A to 24B and 26A to 26B including points 24A, 24B and 26A, 26B. A crease 34, 36 extends transversely across the upper or lower surface of each wing portion from the point 32 to left and right wing tip forward points 24A and 26A, the sections of the wing portions forward of the creases being planar, and the sections 38, 40 of the wing portions rearwardly of the creases being planar and angled upwardly relative to the forward sections by a shallow angle providing full span wing twist wash out, and subsequently functing as adjustable elevons. Elevens function to both pitch and roll a tailess flying wing, simultaneously performing the separate functions that elevators and ailerons perform on a standard configuration aircraft.

The combined nose weight and launch handle 12 is molded and has upper and lower plates 44, 50 respectively, connected by a forward portion 48, the U shaped launch handle 52 extends downwardly from the rear end of the lower plate. The separation between the upper plate 44 and lower plate 50 is slightly less than the thickness of wing 10 so that the nose weight and launch handle engages the wing with a friction fit. Upper plate 44, lower plate 50 and forward portion 48 together comprise both the nose weight of wing 10 and the means of attaching finger grip launch handle 52 to wing 10. U shaped handle 52 is symetric about the longitudinal centerline of the unit, with straight portions 54 and 56, in assembled relationship, aligned transversely across the longitudinal centerline of wing 10. The straight and curved parts of the U 54,56 and 58 respectively, each have substantially equal minimum front and side plan areas and are generally circular in cross section. The straight parts of the launch handle 54 & 56 are approximately ½" in length corresponding to the approximate size of a human finger tip. The horizontal distance separating straight parts 54 & 56 is approximately ⅜", less than the width of a six year old childs index finger or thumb, so that the index finger preferably for maximum control and launching speed & power for looping the glider in flight etc., or thumb may be placed behind the launch handle. Note that no part of the U shaped launch handle 52 is folded back upon itself to form any side by side relationship.

Figure 5:
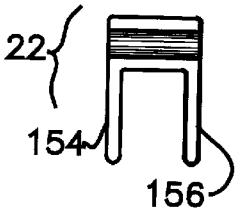
FIG. 5 is a rear plan view of a second embodiment of the nose weight and launch handle.

FIG. 5 shows an alternate form 22 of the noise weight finger grip launch handle 12 depicted in FIGS. 1–4 wherein curved part 58 of FIG. 1–4 is eliminated. Thin posts 154 & 156 remain and constitute the handle portion FIG. 6A and B shows front view and side view B of a third embodiment of a finger gripped launch handle 32 wherein the launch handle portion 74 & 76 is attached to an alternate attaching means consisting of round plate 64 and separate tape piece 65 shown attached to and covering round plate 64 which is atop wing 10, thin post handle portions 74 & 76 extending below wing 10 through two holes in wing 10 aligned symetrically & transversely across the longitudinal centerline of wing 10. Tape piece 65 is also attached to the upper surface of wing 10, thus holding finger grip launch handle 32 in place on wing 10.

Figure 2:
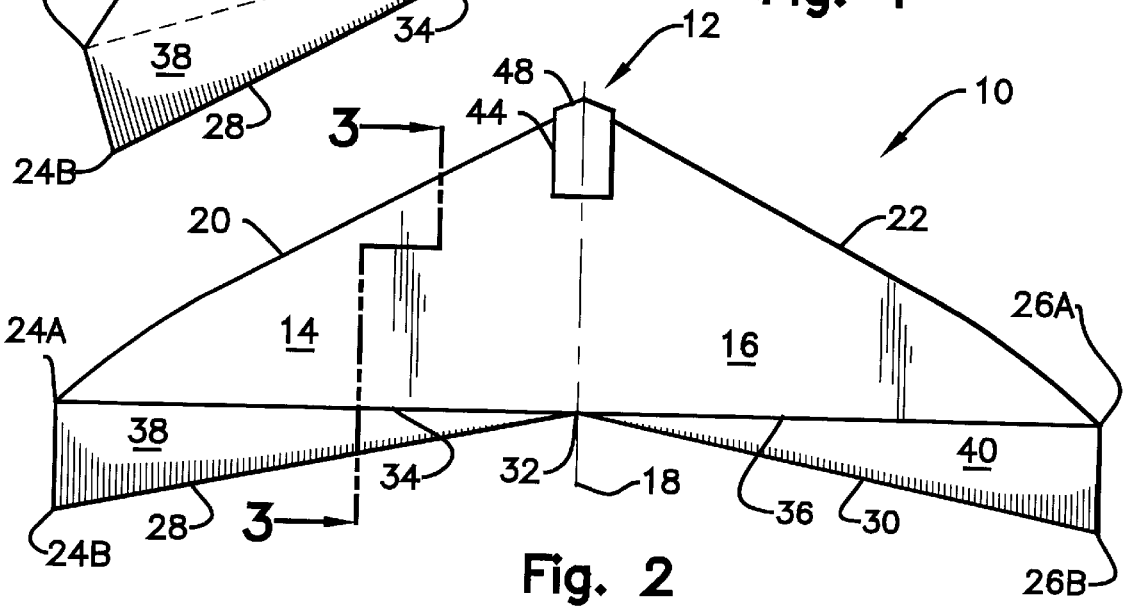
FIG. 2 is a top plan view of the glider of FIG. 1.
Figure 3:
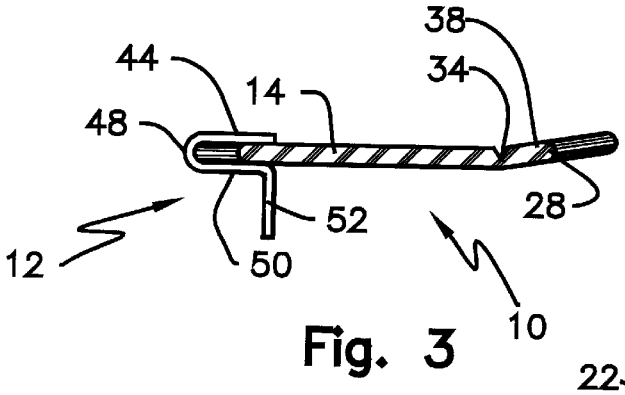
FIG. 3 is a transverse cross sectional view taken on the line 3—3 of FIG. 2.
Figure 4:
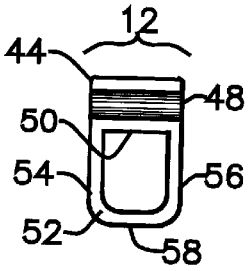
FIG. 4 is a rear plan view showing the nose weight and launch handle.
Figure 8:
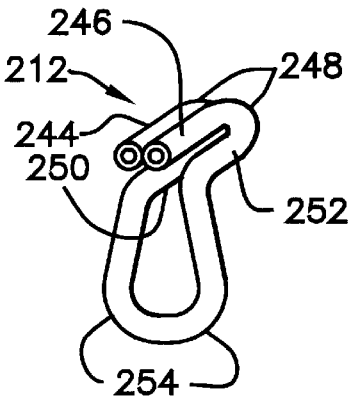
FIG. 8 is a perspective showing of a combined nose weight and launch handle formed from a single length of stiff bendable wire.
Figure 7A:
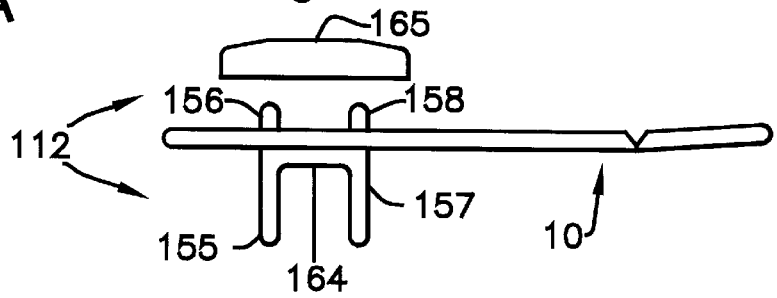
FIG. 7A and B are side plan and front transverse cross sectional views respectively of a fourth embodiment of the launch handle with an attaching means.
Figure 7B:
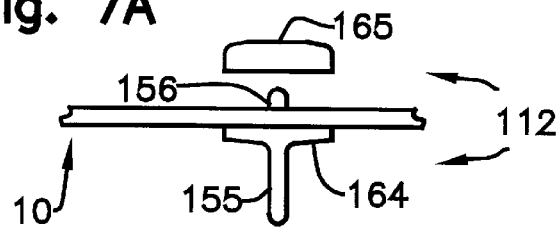

FIG. 7A & B shows side view A and front view B of a forth embodiment of finger gripped launch handle 112 wherein straight handle portions 155, 157 are both aligned along and parallel to the longitudinal centerline of wing 10 of FIGS. 1 & 2. Handle portions 155, 157 are attached to round plate 164 having short straight post sections 156 & 158 extending above round plate 164. Separate round plate 165 has holes that snap down on post sections 156 & 158 extending up through holes in wing. 10, round plate piece 164 remaining, in assembled relationship, below wing 10 thus holding launch handle 112 in place on wing 10. To launch this embodiment one would grip handle portions 155 & 157 between thumb and forefinger. FIG. 8 shows combined nose weight & launch handle 212 and is formed of a length of stiff, bendable wire, preferably vinyl coated. The two end portions 244, 246 of the wire are straight and extend forwardly, in abutting, side-by-side relation to U-shape bends 248 from which lower straight portions 250, 252 extend rearwardly, again in abating, side-by-side relation, to an open loop portion 254 which is bent downwardly at approximately a 90 degree angle to the straight portions. The lengths of the upper and lower straight portions are approximately equal and the separation between the upper portions 244, 246 and the lower portions 250, 252 is slightly less than the thickness of the wing 10 so that the nose weight and launch-handle engages the wing with a friction fit.

Figure 9A:
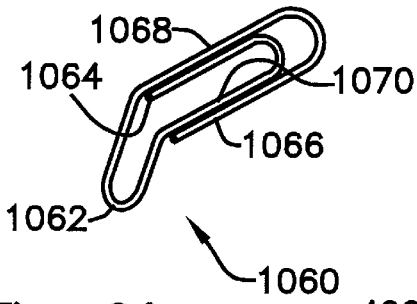
FIGS. 9A and 9B are perspective showings of combined nose weight and launch handles formed from conventional paper clips.

FIG. 9A shows combined nose weight and launch handle 1060 and is formed from a conventional paper clip. As is shown in FIG. 9A, the base U-bend 1062 of the clip is bent downwardly relative to the rest of the clip at approximately a 90 degree angle at a point in line with the ends of the straight legs 1064, 1066 of the clip. This nose weight and launch handle is installed on the forward edge of the wing at the midpoint thereof with the legs 1064, 1066 on the upper surface of the wing and the intermediate straight portions 1068, 1070 on the lower surface.

Figure 9B:
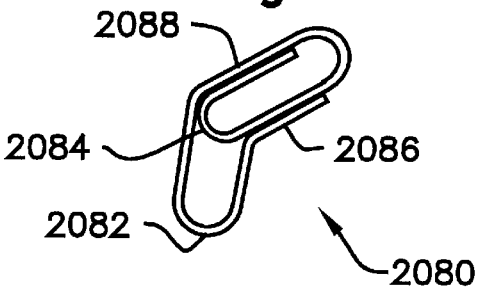

FIG. 9 shows another modification of a combined nose weight and launch handle 2080 and is formed by bending the top U-bend portion 2082 of the clip at approximately a 90 degree angle relative to the remainder of the clip in the vicinity of the point of transition between the intermediate U-bend 2084 and the straight portions 2086, 2088 of the clip.

Figure 10:
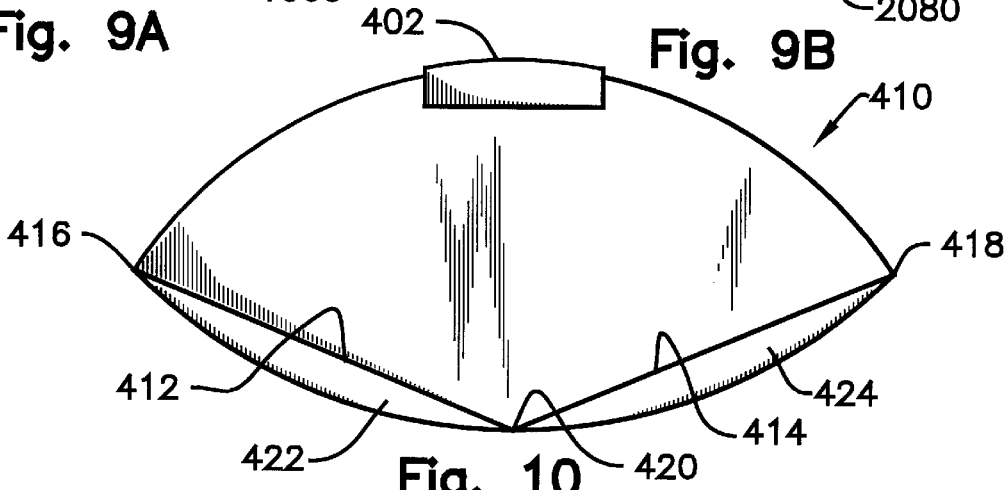
FIG. 10 is a top plan view of a further embodiment of the toy glider having a modified wing configuration.

A modified wing configuration is shown in FIG. 10. In plan, this wing 410 has a shape similar to a football an ellipse which is elongated to wing tip points 416 & 418 on the major axis. The wing is symmetric about its longitudinal axis, coincident with the minor axis of the ellipse, and is provided, on the upper or lower surface thereof, with a pair of creases 412, 414 which extend, respectively, from the wing tip points 416, 418 to the point 420 at the intersection of the longitudinal axis and the rear edge of the wing, the wing portions 422 and 424 rearwardly of the creases being angled upwardly relative to the forward portion of the wing by a shallow angle providing approximate wing twist wash out and subsequently functioning as elevons. As with the previously described embodiments, a combined nose weight and launch handle 402 is provided at the front of the wing on the longitudinal centerline. The nose weight and launch handle may be any one of the types described above.

Figure 11:
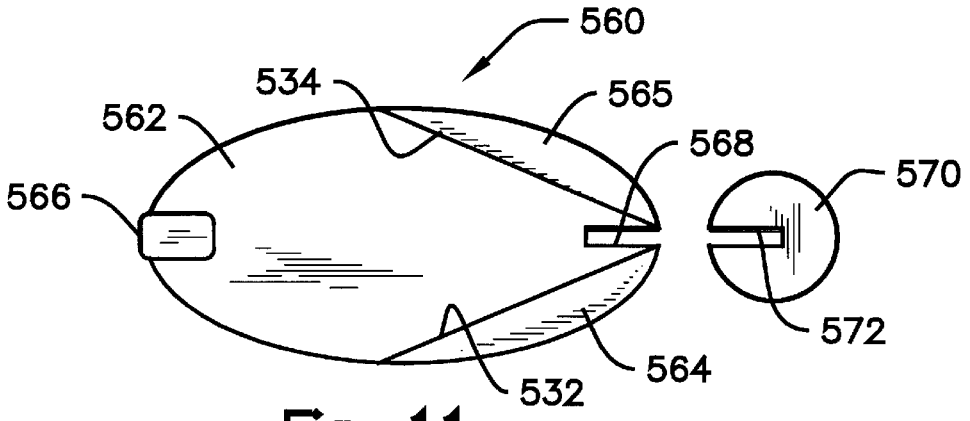
FIG. 11 is an exploded perspective view of a further modification of the toy flying wing glider.

Another modified wing configuration is shown in FIG. 11. The wing 560 is of circular plan, having a planar forward portion 562 and a pair of upwardly directed planer portions 564, 565 providing approximate wing twist and subsequently functioning as elevons, and a nose weight and launch handle 566 at the forward end of the wing on the longitudinal centerline. A notch 568 is formed at the rear end of the wing on the longitudinal centerline for receiving the vertical stabilizer 570, the stabilizer being a circular disk having a radially extending notch 572.

Figure 12:
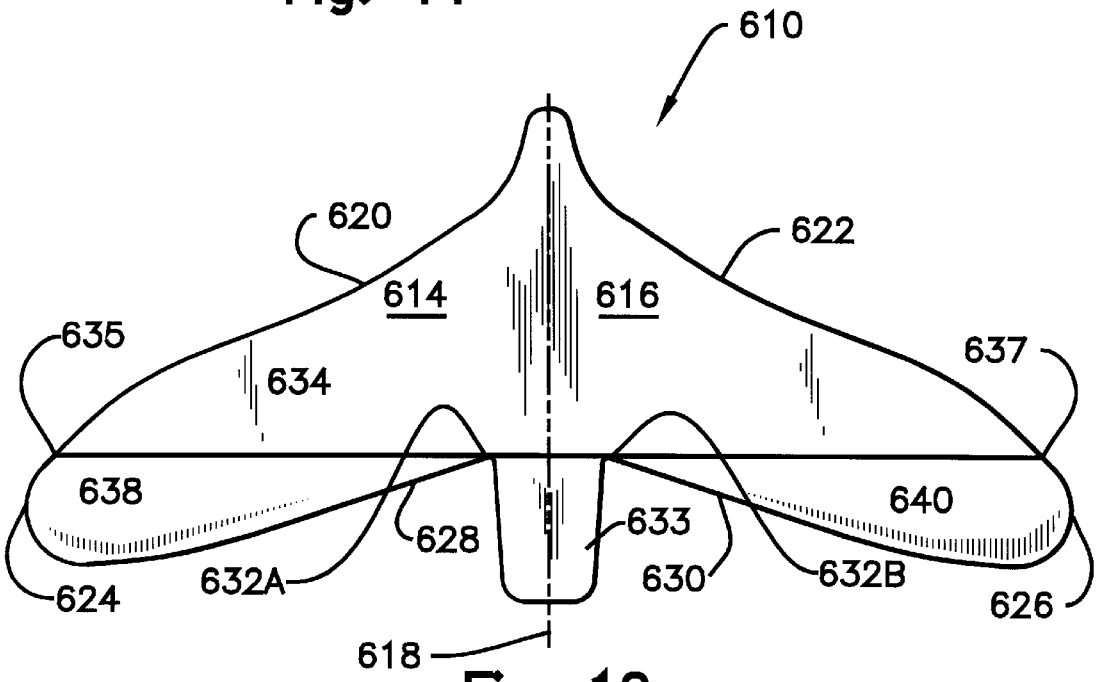
FIG. 12 is a top plan view of a further wing modification.

Another modified wing configuration is shown in FIG. 12. In plan this wing 610 is shaped like a bird, and has left and right half portions 614, 616 which are generally symmetric about the longitudinal centerline 618 of the wing. Extending rearwardly along longitudinal centerline 618 and from trailing edges 628 and 630 is portion 633.

Figure 13:
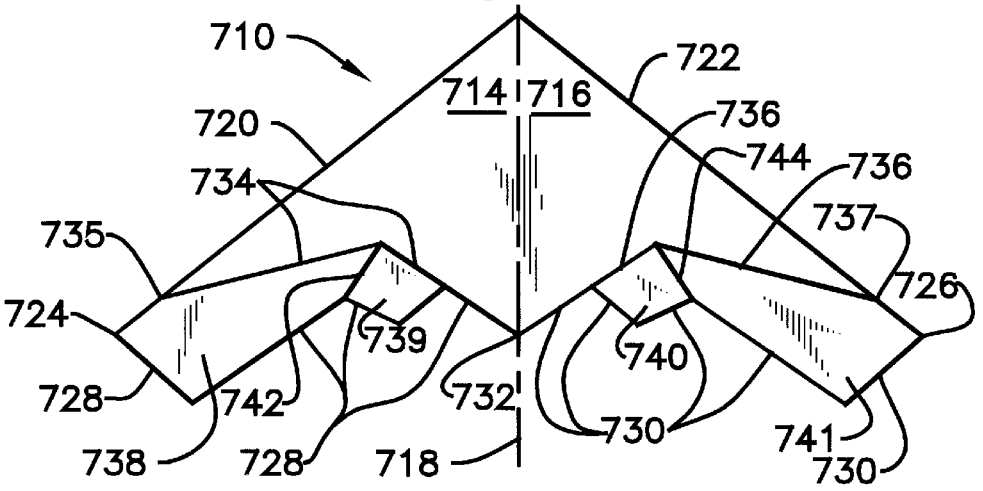
FIG. 13 is a top plan view of a further wing modification.

Another modified wing configuration is shown in FIG. 13. In plan this wing 710 is shaped with swept back straight leading edge halves 720 and 722, and sawtooth shaped trailing edges 728 and 730; and has left and right half portions 714, 716 which are generally symmetric about the longitudinal centerline 718 of the wing. Creases 734 and 736 extend transversely across each wing portion from points 735 and 737 respectively to the point 732 on the longitudinal centerline of the wing at the intersection of trailing edges 728 and 730. Creases 734 and 736 tend to converge upon trailing edges 728 and 730 as creases 734 and 736 run from points 735, 737 on the leading edges 720 and 722 toward point 732. Cut lines 742 and 744 allow planar sections 738, 739, 740 and 741 to be rotated upward. The aforementioned configuration effects majority span wing twist wash out.

Figure 6A:
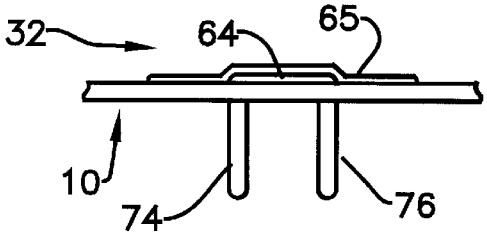
FIG. 6A and B are rear plan and side transverse cross sectional views respectively of a third embodiment of the launch handle with attaching means.
Figure 6B:
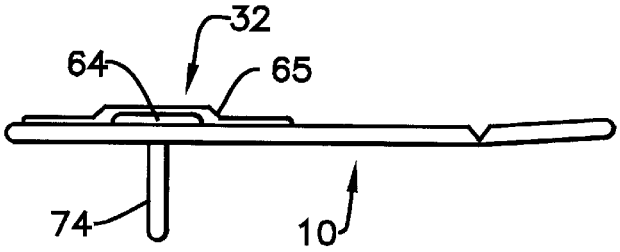

The gliders depicted in FIG. 6A&B, FIG. 7A&B et al may have separate nose weights at the front of the glider.

While preferred embodiments of the invention have been illustrated and described in detail herein, it will be apparent that changes and additions may be had therein and thereto without departing from the spirit of the invention. Reference should, accordingly, be had to the appended claims in determining the true scope of the invention.

I claim:

1. A toy flying wing glider comprising:

a wing formed from a flat sheet of material, said wing having symetric left and right half portions with leading and trailing edges; and a combined nose weight and launch handle slidably receivable on said wing at the front center thereof, said combined nose weight and launch handle including elongate upper and lower portions, an intermediate portion connecting upper and lower portions, and a handle portion connected to and extending downwardly from said lower portion, said upper and lower portions being separated by sliding friction fit between said upper and lower portions and said wing, said combined nose weight and launch handle being formed of a length of stiff, bendable wire, said upper portion consisting of the end portions of said wire length which are straight and in abutting, side-by-side relation, said intermediate portion consists of U-shaped bends, said lower portion consists of sections extending rearwardly from said intermediate portions, and said handle portion is a loop connecting the rear ends of said sections.

2. The toy flying wing glider of claim 1 wherein said wing is of sweptback configuration.

3. A toy flying wing glider comprising:

a wing formed from a flat sheet of material, said wing having symetric left and right half portions with leading and trailing edges; and a combined nose weight and launch handle slidably receivable on said wing at the front center thereof, said combined nose weight and launch handle including elongate upper and lower portions, an intermediate portion connecting said upper and lower portions, and a handle portion connected to and extending downwardly from said lower portion, said upper and lower portions being separated by slightly less than the thickness of said wing whereby providing a sliding friction fit between said upper and lower portions and said wing, said combined nose weight and launch handle being formed from a conventional paper clip of the type having base, top and intermediate U-bends connected by straight portions, the base U-bend and contiguous straight portions being bent at approximately a right angle relative to the remainder of the clip and constituting said handle portion, the intermediate U-bend constituting said intermediate portion.

4. A toy flying wing glider comprising:

a wing formed from a flat sheet of material, said wing having symetric left and right half portions with leading and trailing edges; and a combined nose weight and launch handle slidably receivable on said wing at the front center thereof, said combined nose weight and launch handle including elongate upper and lower portions, an intermediate portion connecting said upper and lower portions, and a handle portion connected to and extending downwardly from said lower portion, said upper and lower portions being separated by slightly less than the thickness of said wing whereby providing a sliding friction fit between said upper and lower portions and said win, said combined nose weight and launch handle being formed from a conventional paper clip of the type having base, top and intermediate U-bends connected by straight portions, the top U-bend and contiguous straight portions being bent at approximately a right angle relative to the remainder of the clip and constitution said handle portion, the base U-bend constituting said intermediate portion.

5. A toy flying wing glider, said wing consisting of a single sheet of material defining a leading edge, a trailing edge and a pair of wing ends, each wing end having a forward most point and a rearward most point, said leading edge having ends which meet the forward most point of each said wing and, said trailing edge having ends which meet the rearward most point of each said wing end, said wing having a longitudinal centerline dividing the wing into two wing halves, said glider further consisting of a combined nose weight and launch handle slidably receivable on said wing at the front center thereof, said combined nose weight and launch handle including elongate upper and lower portions, an intermediate portion connecting said upper and lower portions, and a handle portion connected to and extending downwardly from said lower portion, said upper and lower portions being separated by slightly less than the thickness of said wing whereby providing a sliding friction fit between said upper and lower portions and said wing, said combined nose weight and launch handle being formed on a length of stiff, bendable wire, said upper portion consisting of the end portions of said wire length which are straight end in abutting, side-by-side relating, said intermediate portion consists of U-shaped bends, said lower portion consists of sections extending rearwardly from said intermediate portion, and said handle portion is a loop connecting the rear ends of said sections.

6. A toy flying wing glider, said wing consisting of a single sheet of material defining a leading edge, a trailing edge and a pair of wing ends, each wing end having a forward most point and a rearward most point, said leading edge having ends which meet the forward most point of each said wing end, said, trailing edge having ends which meet the rearward most point of each said wing end, said wing having a longitudinal centerline dividing the wing into two wing halves, said slider further consisting of a combined nose weight and launch handle slidably receivable on said wing at the front center thereof, said combined nose weight and launch handle including elongate upper and lower portions, an intermediate portion connecting said upper and lower portions, and a handle portion connected to and extending downwardly front said lower portion, said upper and lower portions being separated by slightly less than the thickness of said wing whereby providing a sliding friction fit between said upper and lower portions and said wing, said combined nose weight and launch handle being formed of a length of stiff, bendable wire, said upper portion consisting of the end portions of said wire length which are straight and in abutting, side-by-side relation, said intermediate portion consists of U-shaped bends, said lower portion consists of sections extending rearwardly from said intermediate portion, and said handle portion is a loop, the plane of said loop being transversly oriented in relation to said longitudinal centerline of said wing, said loop connecting the rear ends of said sections.

7. A toy flying wing glider, said wing consisting of a single sheet of material defining a leading edge and a trailing edge, said leading edge and said trailing edge having ends which meet at the lateral extremes of said wing, said wing having a longitudinal centerline dividing the wing into two wing halves, said glider further consisting of a combined nose weight and launch handle slidably receivable on said wing at the front center thereof, said combined nose weight and launch handle including elongate upper end lower portions, an intermediate portion connecting said upper and lower portions, and a handle portion connected to and extending downwardly from said lower portion, said upper and lower portions being separated by slightly less than the thickness or said wing whereby providing a sliding friction fit between said upper and lower portions and said wing, said combined nose weight and launch handle being formed from a conventional paper clip of the type having base, top and intermediate U-bends connected by straight portions, the top U-bend and contiguous straight portions being bent at approximately a right angle relative to the remainder of the clip and constituting said handle portion, the base U-bend constituting said intermediate portion.

8. The toy flying wing glider of claim 7 wherein said wing further consists of a crease extending from the point of intersection of said trailing edge and the longitudinal centerline of said wing to the laterally extreme most point of each said wing halves, said crease on each wing half, together, dividing said wing into a forward planar portion and two adjustable rear planar upwardly directed wing twist elevon portions.

9. The toy flying wing glider of claim 7 wherein said wing further has multiple crease extending from a point in the general area of the intersection of said trailing edge and the longitudinal centerline of said wing to a point on each leading edge of said wing halves forward of and near to the lateral extreme most point of each said wing halves, said crease on each wing half, together, dividing said wing into a forward planar portion and multiple adjustable rear planar upwardly directed wing twist elevon portions.

10. A toy flying wing glider, said wing consisting of a single sheet of material defining a leading edge, a trailing edge and a pair of wing ends, each wing end having a forward most point and a rearward most point, said leading edge having ends which meet the forward most point of each said wing end, said trailing edge having ends which meet the rearward most point of each said wing end, said wing having a longitudinal centerline dividing the wing into two wing halves, said glider further consisting of a combined nose weight and launch handle slidably receivable on said wing at the front center thereof, said combined nose weight and launch handle including elongate upper and lower portions, an intermediate portion connecting said upper and lower portions, and a handle portion connected to and extending downwardly from said lower portion, said upper and lower portions being separated by slightly less than the thickness of said wing whereby providing a sliding friction fit between said upper and lower portions and said wing, said combined nose weight and launch handle being formed of injection molded plastic construction, said upper and lower portions being plates, said intermediate portion being a portion connecting said plates along one edge thereof and said handle portion is a loop.

11. The toy flying wing glider of claim 10 wherein the plane of said loop is transversely oriented in relation to said longitudinal centerline of said wing.

12. A toy flying wing glider, said wing consisting of a single sheet of material defining a leading edge and a trailing edge, said leading edge and said trailing edge having ends which meet at the lateral extremes of said wing, said wing having a longitudinal centerline dividing the wing into two wing halves, said glider further consisting of a combined nose weight and launch handle slidably receivable on said wing at the front center thereof said combined nose weight and launch handle including elongate upper and lower portions, an intermediate portion connecting said upper and lower portions, and a handle portion connected to and extending downwardly front said lower portions said upper and lower portions being separated by slightly less than the thickness of said wing whereby providing a sliding friction fit between said upper and lower portions and said wing, said combined nose weight and launch handle being formed of injection molded plastic construction, said upper and lower portions being plates, said intermediate portion being a portion connecting said plates along one edge thereof and said handle portion is a U-bend, the plane of said U-bend being transversely oriented in relation to said longitudinal centerline of said wing.

13. A toy flying wing glider, said wing consisting of a single sheet of material defining a leading edge, a trailing edge and a pair of wing ends, each wing end having a forward most point and a rearward most point, said leading edge having ends which meet the forward most point of each said wing end, said trailing edge having ends which meet the rearward most point of each said wing end, said wing having a longitudinal centerline dividing the wing into two wing halves, said glider further consisting of a combined nose weight and launch handle slidably receivable on said wins at the front center thereof, said combined nose weight and launch handle including elongate upper and lower portions, an intermediate portion connecting said upper and lower portions, and a handle portion connected to and extending downwardly from said lower portion, said upper and lower portions being separated by slightly less than the thickness of said wing whereby providing a sliding friction fit between said upper and lower portions and said wing, said combined nose weight and launch handle being formed of injection molded plastic construction, said upper and lower portions being plates, said intermediate portion being a portion connecting said plates along one edge thereof and said handle portion being two thin posts separated transversely across said longitudinal centerline of said wing.

14. The toy flying wing glider of claim 5, 6, 13 wherein said wing further consists of a crease extending from the point of intersection of said trailing edge and the longitudinal centerline of said wing to the forward most point of each said wing end of said wing halves, said crease on each wing half, together, dividing said wing into a forward planar portion and two adjustable rear planar upwardly directed wing twist elevon portions.

* * * * *